US005938011A

United States Patent [19]

Holzapfel et al.

[11] Patent Number: 5,938,011

[45] Date of Patent: Aug. 17, 1999

[54] MULTIPLE CONTAINER PACKAGE AND METHOD OF ASSEMBLY

[75] Inventors: Hank L. Holzapfel; Dennis R. Marsh, both of Toledo, Ohio

[73] Assignee: Owens-Illinois Labels Inc., Toledo, Ohio

[21] Appl. No.: 08/965,976

[22] Filed: Nov. 7, 1997

Related U.S. Application Data

[63] Continuation-in-part of application No. 08/619,223, Mar. 21, 1996, Pat. No. 5,701,994.

[51] Int. Cl.[6] ..... B65D 71/08

[52] U.S. Cl. ..... 206/203; 206/432; 220/515; 53/398

[58] Field of Search ..... 206/203, 427, 206/139, 151, 153, 154, 162, 431, 432, 497, 564; 220/512, 515, 507, 509, 513, 516, 517, 519; 493/926; 53/48.1, 398, 478

[56] References Cited

U.S. PATENT DOCUMENTS

| | | | |
|---|---|---|---|
| 3,151,762 | 10/1964 | Vidal . | |
| 3,184,148 | 5/1965 | Poupitch . | |
| 3,203,583 | 8/1965 | Amburg et al. . | |
| 3,351,264 | 11/1967 | Bostrom . | |
| 3,353,326 | 11/1967 | Becker . | |
| 3,650,395 | 3/1972 | Hobbs . | |
| 3,991,880 | 11/1976 | Austrins et al. | 206/432 |
| 4,062,448 | 12/1977 | Meighan | 206/432 |
| 4,093,068 | 6/1978 | Smrt . | |
| 4,207,221 | 6/1980 | Tobias et al. . | |
| 4,269,308 | 5/1981 | Platt . | |
| 4,344,530 | 8/1982 | DeLarosiere . | |
| 4,475,653 | 10/1984 | Ullman | 206/432 |
| 4,487,312 | 12/1984 | Heider . | |
| 4,609,101 | 9/1986 | Ullman | 206/432 |
| 4,700,836 | 10/1987 | Hammett . | |
| 4,754,879 | 7/1988 | Benno . | |
| 4,830,895 | 5/1989 | Bernard | 206/432 |
| 4,834,243 | 5/1989 | Langenbeck . | |
| 4,872,560 | 10/1989 | Langenbeck . | |
| 4,928,841 | 5/1990 | Arthurs . | |
| 4,953,702 | 9/1990 | Bryan | 206/432 |
| 5,529,176 | 6/1996 | Apps et al. . | |

FOREIGN PATENT DOCUMENTS

| | | |
|---|---|---|
| 936135 | 10/1973 | Canada . |
| 646435 | 10/1964 | Germany . |
| 901578 | 12/1990 | WIPO . |

*Primary Examiner*—Paul T. Sewell
*Assistant Examiner*—Luan K. Bui

[57] ABSTRACT

A multiple-container package that includes a plastic tray having a base with an integral peripheral wall, a plurality of pockets in the base and flange portions extending along opposite sides of the peripheral wall. A plurality of filled and closed containers, such as beverage containers, each has a lower end received in one of the tray pockets in an upper end spaced above the tray. A canopy in the form of a thin plastic sheet engages the upper ends of the containers, and is stretched taut over the containers. The side edges of the canopy sheet are secured to the undersides of the flange portions of the tray in such a way that residual stresses in the canopy sheet, which hold the containers in the tray pockets, exert shear stresses on the securement bond between the sheet and the tray flanges. A handle in the form of a thin flexible plastic strip is secured at opposite ends to lateral ends the tray and extends over the canopy for manually carrying the tray and package in horizontal orientation.

18 Claims, 3 Drawing Sheets

MULTIPLE CONTAINER PACKAGE AND METHOD OF ASSEMBLY

This application is a continuation-in-part of application Ser. No. 08/619,223 filed Mar. 21, 1996, U.S. Pat. No. 5,701,994.

The present invention relates to multiple-container packages and methods of assembly.

BACKGROUND AND SUMMARY OF THE INVENTION

Parent application Ser. No. 08/619,223, filed Mar. 21, 1996 and assigned to the assignee hereof, discloses a multiple-container package that includes a plastic tray having a base with an integral peripheral wall and a plurality of recesses or pockets in the base. A plurality of containers each have a lower end received within one of the pockets in the base, and an upper end spaced above the tray. A canopy in the form of a thin plastic sheet is stretched taut over the upper ends of the containers, and is secured to flanges that extend from opposite side edges of the tray peripheral wall. Specifically, the edges of the canopy sheet are secured to the upper surfaces of the flanges, so that the residual stress within the canopy sheet, which holds the containers within their tray pockets, exerts stress on the bond between the canopy sheet and the base flanges that tends to peel the sheet edges from the flanges.

Although the multiple-container package so disclosed in the parent application has addressed problems theretofore except in the art, further improvements remain desirable. For example, it has been found desirable to strengthen the bond between the canopy sheet and the tray to prevent separation and possible dropping of one or more containers. It has also been found desirable to provide a carrying handle so secured to the base as to maintain the package in horizontal orientation during transport by a user. It is therefore a general object of the present invention to provide a package and method of assembly that obtain improved bonding between the canopy sheet and the tray edges, and/or in which a handle is provided for carrying the package in horizontal orientation. Another and more specific object of the present invention is to provide a package and method of assembly in which the handle is secured to the package in such a way as to strengthen the bond between the canopy sheet edges and the tray.

A multiple-container package in accordance with a presently preferred embodiment of the invention includes a plastic tray having a base with an integral peripheral wall, a plurality of pockets in the base and flange portions extending from opposite side edges of the peripheral wall. A plurality of filled and closed containers, such as beverage containers, each has a lower end received in one of the tray pockets in an upper end spaced above the tray. A canopy in the form of a thin plastic sheet engages the upper ends of the containers, and is stretched taut over the containers. The side edges of the canopy sheet are secured to the undersides of the flange portions of the tray in such a way that residual stresses in the canopy sheet, which hold the containers in the tray pockets, exert shear stresses on the securement bond between the sheet and the tray flanges. This bond arrangement has been found to be three to four times stronger than the arrangement disclosed in the parent application described above.

In accordance with another aspect of the present invention, a handle in the form of a flexible plastic strip is secured at opposed ends to lateral sides of the tray and extends over the canopy. The mid-portion of the handle that overlies the canopy preferably is normally disposed between upper ends of the containers retained in the tray by the canopy so as not to present an obstruction to stacking the packages in overlying relationship. The mid-portion of the handle may be grasped and lifted for carrying the multiple-container package in horizontal orientation. The end portions of the handle strip most preferably are secured to both the tray and the canopy adjacent to the tray flanges for increasing the effective strength of the bond between the canopy sheet and the tray. The peripheral wall of the tray preferably has laterally opposed flat portions to which the ends of the handle strip are secured.

BRIEF DESCRIPTION OF THE DRAWINGS

The invention, together with additional objects, features and advantages thereof, will be best understood from the following description, the appended claims and accompanying drawings in which:

DETAILED DESCRIPTION OF THE PREFERRED EMBODIMENTS

Figure 1:
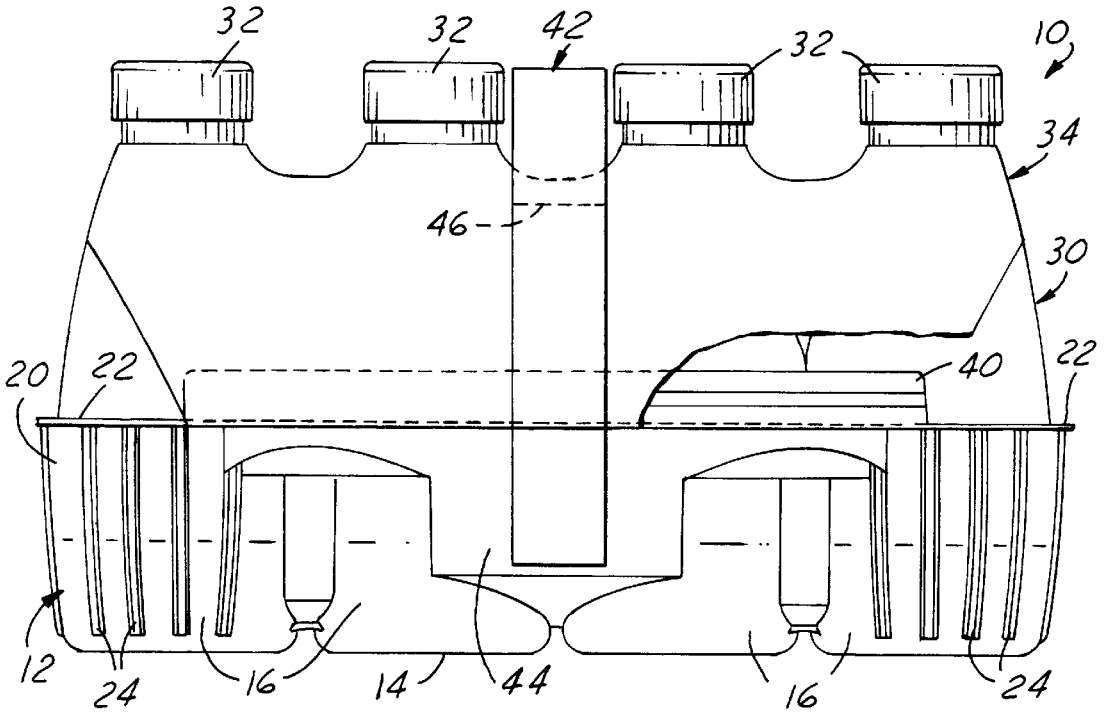
FIG. 1 is a side elevational view of a multiple-container package in accordance with one presently preferred embodiment of the invention.

The disclosure of parent application Ser. No. 08/691,223, filed Mar. 21, 1996 and assigned to the assignee hereof, is incorporated herein by reference.

FIGS. 1–6 illustrate a multiple-container package 10 in accordance with a presently preferred embodiment of the invention as comprising a rectangular tray 12 of semi-rigid shape-retaining thermoformed plastic composition, such as high density polyethylene. Tray 12 has a base 14 in which a plurality of recesses or pockets 16 (FIG. 4) are formed in a row-and-column array. Each recess or pocket 16 has a bottom surface formed with a plurality of radially extending ribs 18. A peripheral wall 20 extends upwardly and integrally from the outer edge of base 14, terminating in a radially outwardly extending strengthening lip or flange 22. Wall 20 has a plurality of vertical outwardly formed strengthening ribs 24 that extend around each corner of the tray for strengthening the corners of the tray. A drain opening 26 (FIG. 4 and 5) is formed in the pocket 16 at each corner of the rectangular tray.

Figure 2:
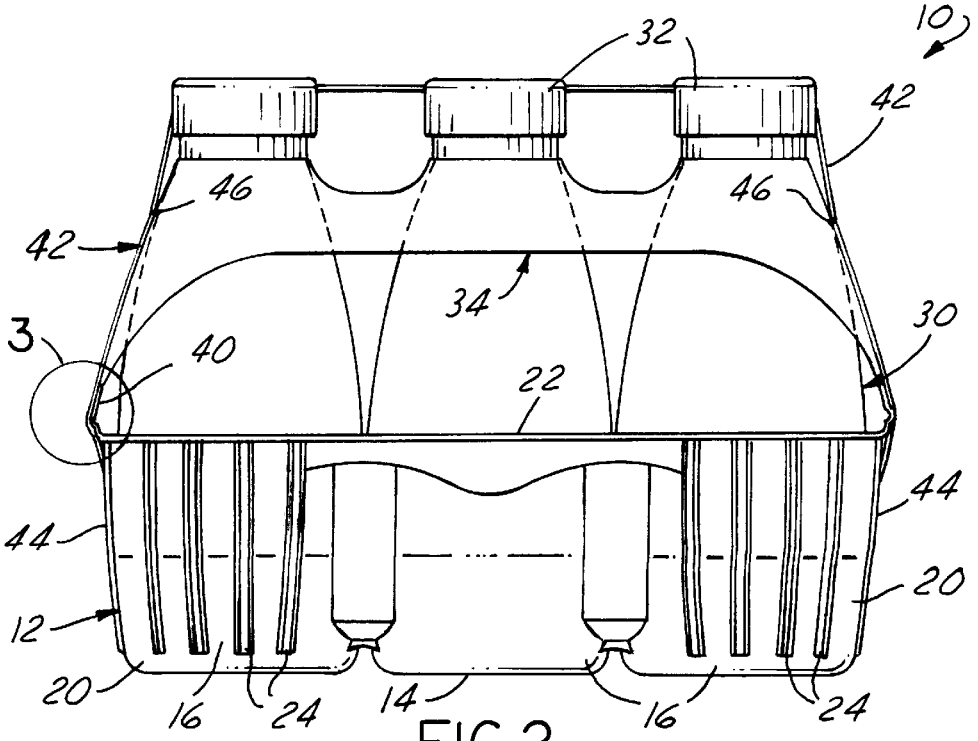
FIG. 2 is an end elevational view of the package illustrated in FIG. 1.
Figure 3:
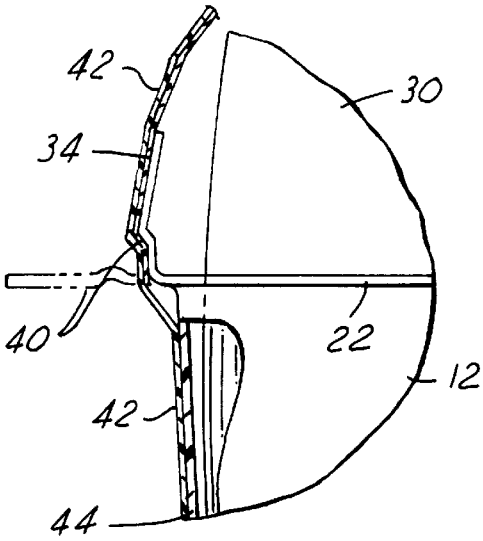
FIG. 3 is a fragmentary sectional view of the portion of the package within the circle 3 in FIG. 2.
Figure 4:
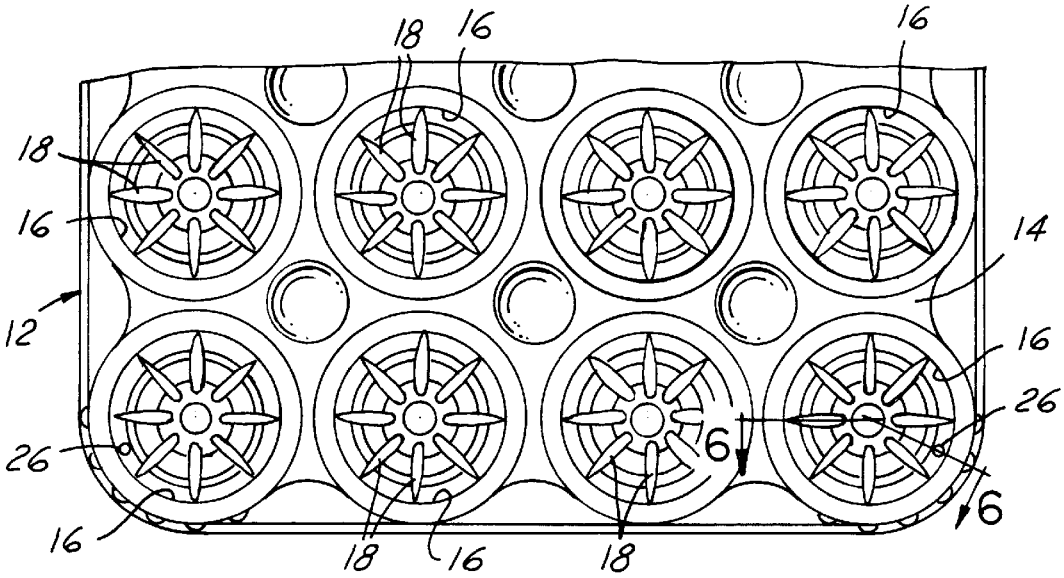
FIG. 4 is a fragmentary top plan view of the tray in the package of FIGS. 1–3.
Figure 5:
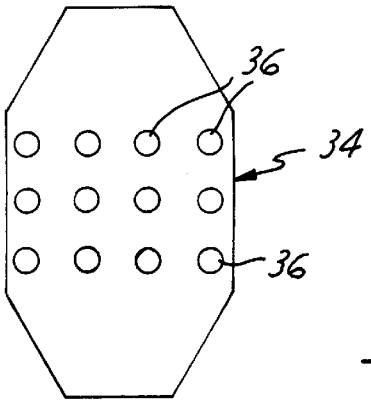
FIG. 5 is a fragmentary plan view of the canopy sheet in the package of FIGS. 1–3.

A capped and filled beverage container 30 has a lower end or base disposed within each pocket 16 of tray 12. Tray 12 is so contoured that the several containers 30 are in side-by-side abutment with each, as best seen in FIGS. 1 and 2. Each container 30 has an associated removable cap 32 disposed at the upper end thereof remote from tray 12. A canopy 34 takes the form of a thin plastic sheet of generally rectangular contour, having opposed tapering side extensions as best seen in FIG. 5. A plurality of openings 36 are preformed in the central portion of sheet 34, for purposes to be described. Sheet 34 may be of high density or low density polyethylene composition, having a thickness in the range of 0.002 inches to 0.004 inches, for example. Tray 12 may be of high density polyethylene composition, preferably with 25% post consumer resin and regrind, and may include colorant as desired. The wall thickness of tray 12 may be in the range of 0.032 to 0.038 inches, preferably about 0.036 inches.

Openings 36 in canopy sheet 34 are tightly received over caps 36 of containers 30. With sheet 34 stretched taut over the upper ends of the containers, the opposed edges of sheet 34 are secured to the undersides of flanges 40 that extend laterally outwardly from lip 22 on opposed sides of tray 12. That is, on opposed lateral sides of tray 12, lip 22 at the upper edge of peripheral wall 20 is enlarged so as to form flange portions 40. The opposed edges of canopy sheet 34 are secured to the undersides of the opposed flanges 40 by welding or other suitable means. The residual tension stresses within canopy sheet 34 thus apply a shear stress to the bond between canopy 34 and tray flanges 40, which bond is three to four times as strong to shear stress as the bond that receives peal stress in the arrangement disclosed in the parent application. Tray 12 is designed to accommodate the container, and canopy sheet 34 is designed to fit the tray.

A handle 42, in the form of a thin strip of plastic composition such as polyethylene, extends laterally over canopy 34 between opposed side edges of tray 12 for carrying package 10. More specifically, the opposed ends of handle strip 42 are secured to flat peripheral wall portions 44 centrally disposed on opposite sides of tray 12. The mid-portion of handle strip 44 overlies canopy sheet 34 between caps 32 of containers 30 and is disposed centrally of the longitudinal dimension of the tray. Most preferably, the opposed ends of handle strip 42 are also secured to canopy sheet 34 over the bond between the canopy sheet and flanges 40 up to the position 46 in FIGS. 1 and 2. This arrangement provides added strength to the bond between canopy sheet 34 and tray 12. That is, the opposed ends of handle strip 42, which are adhesively secured to tray 12 at 44 and canopy 34 up to 46, function to reinforce the bond between the opposed edges of canopy sheet 34 and flange portions 40 of tray 12.

Figure 6:
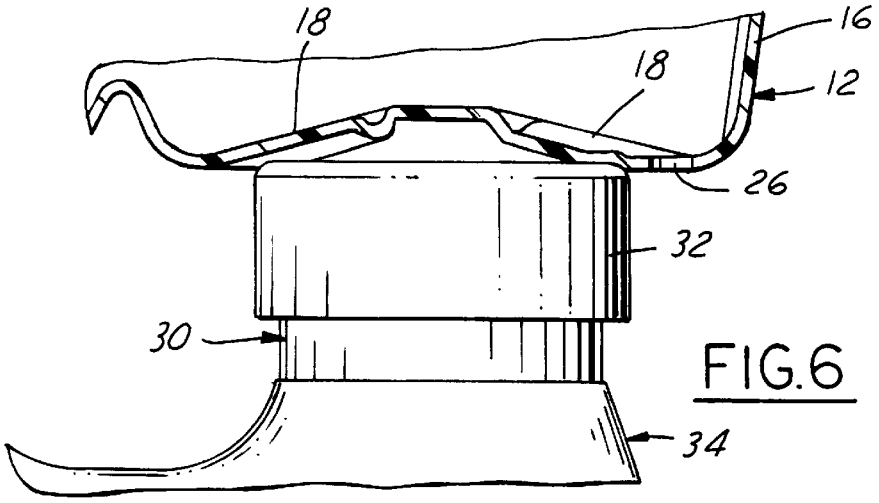
FIG. 6 is a fragmentary elevational view that illustrates the top of a container internesting with the underside of the tray in an overlying package assembly.

As best seen in FIG. 6, the ribs 18 within each pocket 16 of tray 12 extend upwardly into each pocket. The lower face of each pocket 16 is contoured to receive and engage the cap 32 of a container 30 in an underlying package, so that packages may be stacked and nested overlying each other. Disposition of the mid-portion of handle 42 between the caps 32 of adjacent rows of containers 30 locates the handle in a position not to obstruct overlying nesting of container packages. When handle 42 is grasped by a user, the handle will stretch to a position above the plane of caps 32, so that it may be readily grasped by a user.

Figure 7:
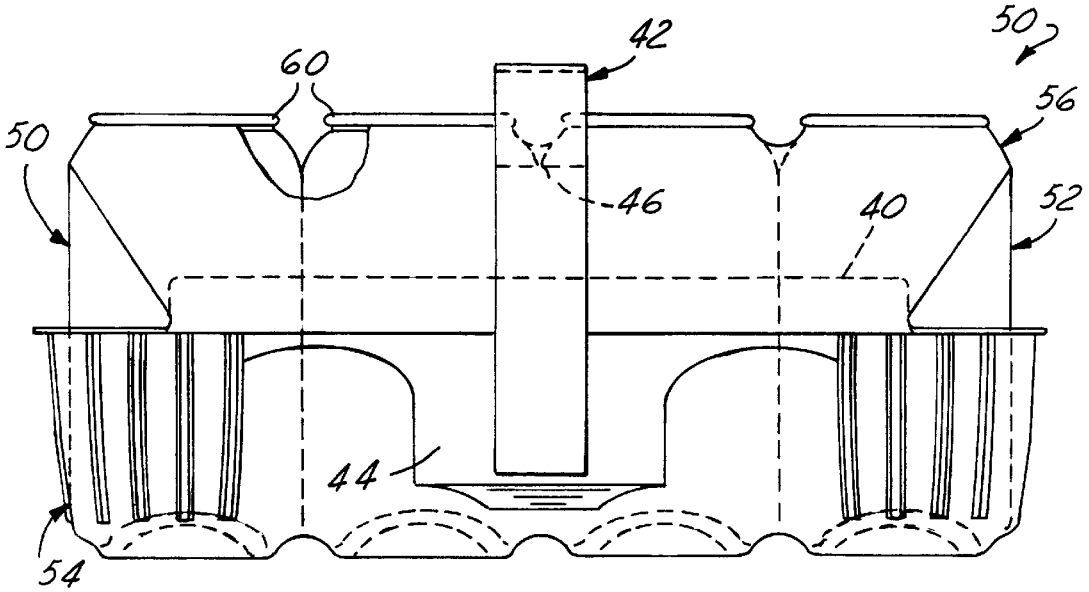
FIG. 7 is a side elevational view of a modified multiple-container package in accordance with the present invention.
Figure 8:
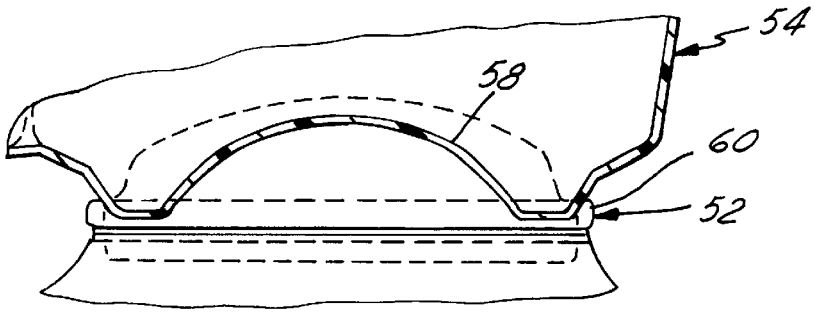
FIG. 8 is a fragmentary side sectional view that illustrates nesting of overlying packages in the embodiment of FIG. 7.

FIGS. 7 and 8 illustrate a modified package 50 for securing aluminum cans 52 within a tray 54. As in the previous embodiment 10, a canopy sheet 56 extends over the upper ends of cans 52, and opposed side edges are secured to the undersides of flanges 40 integral with tray 54. Canopy 56 is thus securely fastened to tray 54 and holds cans 52 within their respective tray pockets. Carrying handle strip 42 is secured to and extends between flat wall portions 44 on opposite sides of tray 54, and is secured to canopy 56 up to position 46. Base 58 of tray 54 is contoured to nest within the rims 60 of cans 52 for nested stacking of container packages as previously described.

We claim:

1. A multiple container package that comprises:

a plastic tray having a base with an integral peripheral wall and a plurality of pockets in said base, a plurality of containers each having a lower end receiver in one of said pockets and an upper end spaced above said tray, and a canopy comprising a plastic sheet engaging the upper ends of said containers, said tray having flange portions extending from laterally opposed sides of said peripheral wall, and said canopy being stretched taut over the containers and secured to undersides of said flange portions such that residual stresses in said canopy hold said containers in said tray pockets and exert shear stresses on securement between said sheet and said flange portions.

2. The package set forth in claim 1 further comprising a handle in the form of a flexible plastic strip secured at opposed ends to said tray at said flange portions and extending laterally over said canopy.

3. The package set forth in claim 2 wherein said peripheral wall of said tray has flat wall portions on opposed sides of said tray beneath said flange portions, and where said handle strip is secured at opposed ends to said flat wall portions.

4. The package set forth in claim 3 wherein opposed ends of said handle strip extend along and are secured to said canopy adjacent to said flange portions.

5. The package set forth in claim 1 wherein said tray is rectangular, with said flange portions being disposed, and said canopy sheet being secured to said flange portions, on laterally opposed sides of said tray.

6. The package set forth in claim 5 further comprising drain openings in said pockets at corners of said tray.

7. The package set forth in claim 1 wherein said canopy sheet has a plurality of openings each received over an upper end of one of said containers.

8. The package set forth in claim 7 wherein said containers comprise capped bottles.

9. The package set forth of claim 7 wherein said containers comprise cans.

10. A multiple-container package that comprises:

a plastic tray having a base with an integral peripheral wall and a plurality of pockets in said base, a plurality of containers each having a lower end received in one of said pockets and an upper end spaced above said tray, a canopy comprising a plastic sheet stretched taut over the upper ends of the containers and affixed to said base at opposed sides of said peripheral wall, and a handle in the form of a flexible plastic strip secured at opposed ends directly to said tray and extending over said canopy.

11. The package set forth in claim 10 wherein said peripheral wall of said tray has flat wall portions on opposed sides of said tray, and wherein said handle strip is secured at said opposed ends to said flat wall portions of said tray.

12. The package set forth in claim 11 wherein opposed ends of said handle strip extend along and are secured to said canopy adjacent to said flat wall portions of said tray.

13. The package set forth in claim 12 wherein said canopy sheet has a plurality of openings each received over an upper end of one of said containers, and wherein said handle strip has a mid-portion between said end portions overlying said canopy sheet between the upper ends of the containers.

14. The package set forth in claim 13 wherein said tray has flange portions extending from laterally opposed sides of said peripheral wall, and said canopy is stretched taut over the containers and secured to undersides of said flange portions such that residual stresses in said canopy hold said containers in said tray pockets and exert shear stresses on securement between said sheet and said flange portions.

15. The package set forth in claim 14 wherein said tray is rectangular, with said flange portions being disposed, and said canopy sheet being secured to said flange, on laterally opposed sides of said tray.

16. A method of making a multiple container package that comprises the steps of (a) providing a plastic tray having a base with an integral peripheral wall, flange portions extending from opposite sides of said peripheral wall and a plurality of pockets in said base, (b) positioning a container in each of said pockets so that upper ends of said containers are spaced from said base, (c) stretching a canopy in the form of a plastic sheet over the upper ends of the containers, and (d) securing ends of the canopy sheet to undersides of said flanges such that tension in said sheets holds the containers in said pockets and exert shear stresses on securement of the sheet to the flange portions.

17. The method set forth in claim 16 comprising the additional step of (e) securing a handle in the form of a flexible plastic strip to said tray at said flange portions on opposite ends of said tray so that a mid-portion of the strap extends over said canopy.

18. The method set forth in claim 17 wherein said step (e) includes the step of securing said end portions of said strip to said canopy adjacent to said flanges to strengthen securement of said canopy to said tray.

* * * * *